US011277698B2

(12) United States Patent
Wagner et al.

(10) Patent No.: US 11,277,698 B2
(45) Date of Patent: Mar. 15, 2022

(54) CANAL HEARING DEVICES WITH IMPROVED SEALS

(71) Applicant: Sonova AG, Stäfa (CH)

(72) Inventors: Paul Wagner, Meilen (CH); Barjinder Chana, Dublin, CA (US); Michael Au, Union City, CA (US); Petra Gunde, Zurich (CH); Torben Gillich, Hombrechtikon (CH); Simone Keller, Meilen (CH); Erdal Karamuk, Männedorf (CH)

(73) Assignee: Sonova AG, Staefa (CH)

( * ) Notice: Subject to any disclaimer, the term of this patent is extended or adjusted under 35 U.S.C. 154(b) by 4 days.

(21) Appl. No.: 16/765,680

(22) PCT Filed: Nov. 24, 2017

(86) PCT No.: PCT/US2017/063181
§ 371 (c)(1),
(2) Date: May 20, 2020

(87) PCT Pub. No.: WO2019/103748
PCT Pub. Date: May 31, 2019

(65) Prior Publication Data

US 2020/0296527 A1 Sep. 17, 2020

(51) Int. Cl.
*H04R 25/00* (2006.01)

(52) U.S. Cl.
CPC ..... *H04R 25/652* (2013.01); *H04R 25/602* (2013.01); *H04R 2225/023* (2013.01)

(58) Field of Classification Search
CPC ..... H04R 2460/17; H04R 2225/023; H04R 2225/025
USPC ..... 381/322, 325, 328
See application file for complete search history.

(56) References Cited

U.S. PATENT DOCUMENTS

| | | | | |
|---|---|---|---|---|
| 5,682,020 | A | 10/1997 | Oliveira | |
| 6,000,492 | A * | 12/1999 | Puthuff | H04R 25/654 181/135 |
| 6,129,174 | A | 10/2000 | Brown et al. | |
| 7,113,611 | B2 * | 9/2006 | Leedom | H04R 25/65 381/322 |
| 7,580,537 | B2 * | 8/2009 | Urso | H04R 25/652 381/322 |
| 9,060,234 | B2 | 6/2015 | Wagner et al. | |

(Continued)

FOREIGN PATENT DOCUMENTS

| | | | |
|---|---|---|---|
| EP | 2625871 | B1 | 9/2016 |
| WO | WO 99/07182 | A1 | 2/1999 |
| WO | WO 99/51058 | A1 | 10/1999 |

OTHER PUBLICATIONS

PCT Search Report dated Oct. 11, 2018 for PCT App. Ser. No. PCT/US2017/063181.

*Primary Examiner* — Suhan Ni
(74) *Attorney, Agent, or Firm* — Henricks Slavin LLP

(57) ABSTRACT

Hearing devices, configured to fit within the ear canal, having a hearing device core defining an exterior surface with a medial end and a medial corner, and including a battery, a microphone and a receiver, at least one seal, defining a seal compliance, carried on the hearing device core, and a medial bumper, defining a medial bumper compliance that is greater than the seal compliance, carried on the hearing device core.

17 Claims, 10 Drawing Sheets

(56) References Cited

U.S. PATENT DOCUMENTS

| | | | | |
|---|---|---|---|---|
| 2006/0050914 | A1* | 3/2006 | Urso | H04R 25/656 381/328 |
| 2007/0071265 | A1 | 3/2007 | Leedom et al. | |
| 2009/0052710 | A1 | 2/2009 | Smith | |
| 2014/0119584 | A1* | 5/2014 | Lafort | H04R 25/603 381/322 |
| 2015/0281861 | A1 | 10/2015 | Karamuk et al. | |
| 2016/0066110 | A1 | 3/2016 | Shennib et al. | |

* cited by examiner

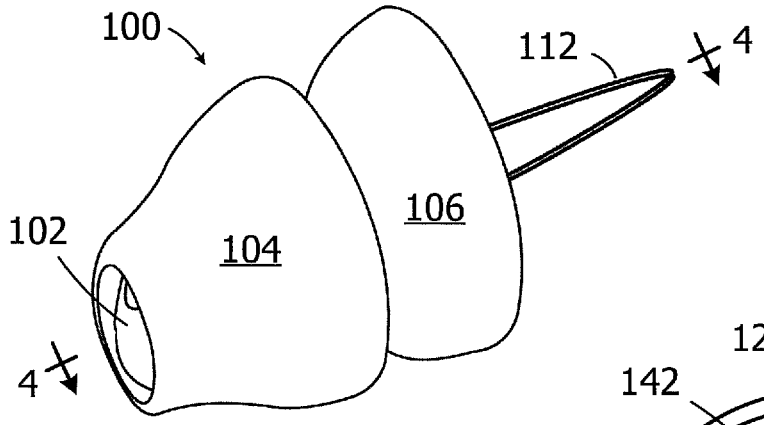
FIG. 2
Prior Art
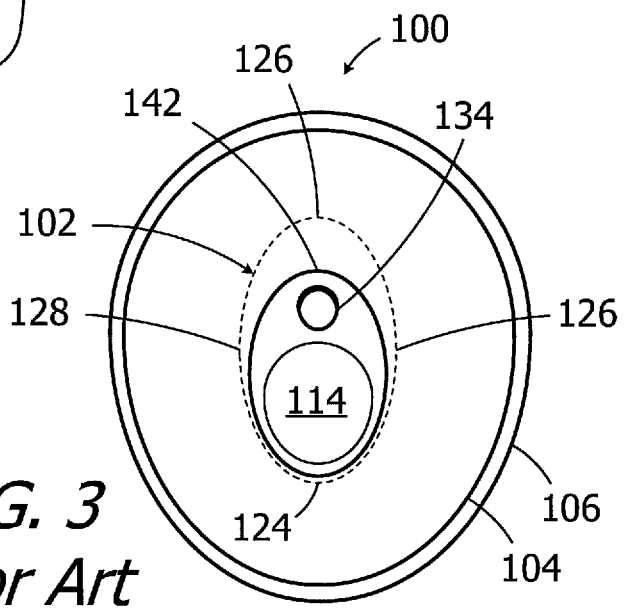
FIG. 3
Prior Art
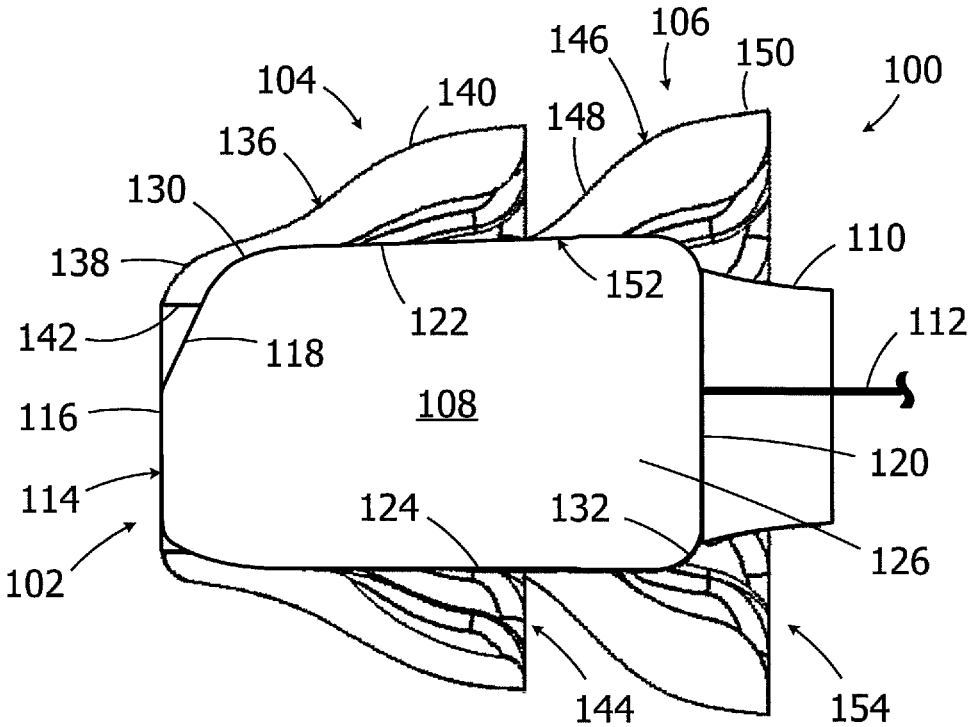
FIG. 4 – Prior Art

CANAL HEARING DEVICES WITH IMPROVED SEALS

CROSS-REFERENCE TO RELATED APPLICATIONS

This application is the U.S. National Stage of PCT App. Ser. No. PCT/US2017/063181, filed Nov. 24, 2017.

BACKGROUND

1. Field

The present inventions relate generally to hearing devices and, for example, hearing devices that are worn entirely in the ear canal for extended periods without daily insertion and removal.

2. Description of the Related Art

Referring to the coronal view illustrated in FIG. 1, the adult ear canal 10 extends from the canal aperture 12 to the tympanic membrane (or "eardrum") 14, and includes a lateral cartilaginous region 16 and a bony region 18 which are separated by the bony-cartilaginous junction 20. The bony region 18 is typically not a straight tube with perfectly elliptical cross-section and, instead, includes varying combinations of bends, twists, platform steps, cross-sectional asymmetries, and/or significant reductions in diameter from the bony-cartilaginous junction 20 to the middle of the bony region (referred to collectively herein as "bony region imperfections"). Debris 22 and hair 24 in the ear canal are primarily present in the cartilaginous region 16. The concha cavity 26 and auricle 28 are located lateral of the ear canal 10, and the junction between the concha cavity 26 and cartilaginous region 16 of the ear canal at the aperture 12 is also defined by a characteristic bend 30, which is known as the first bend of the ear canal.

Extended wear hearing devices are configured to be worn continuously, from several weeks to several months, inside the ear canal. Some extended wear hearing devices are configured to rest entirely within the bony region and, in some instances, within 4 mm of the tympanic membrane. Examples of extended wear hearing devices are disclosed in U.S. Patent Pub. No. 2009/0074220, U.S. Pat. Nos. 7,664,282 and 8,682,016, each of which is incorporated herein by reference.

One example of a conventional extended wear hearing device is the device 100 illustrated in FIGS. 2-4. The hearing device 100 includes a core 102, a medial seal 104, and a lateral seal 106. It should be noted that as used herein, the term "lateral" refers to the direction and parts of hearing devices which face away from the tympanic membrane, the term "medial" refers to the direction and parts of hearing devices which face toward the tympanic membrane, the term "superior" refers to the direction and parts of hearing devices which face the top of the head, the term "inferior" refers to the direction and parts of hearing devices which face the feet, the term "anterior" refers to the direction and parts of hearing devices which face the front of the body, and the "posterior" refers to the direction and parts of hearing devices which face the rear of the body.

The core 102 includes components such as a microphone, a receiver and a battery within a housing 108. A contamination guard 110 and a handle 112 may also be provided. The core 102 has a medial end 114 with surfaces 116 and 118, a lateral end 120, a superior end 122, an inferior end 124, an anterior side 126, and a posterior side 128. A curved medial corner 130 connects the medial end 114 to the superior end 122, inferior end 124, anterior side 126 and posterior side 128, while a curved lateral corner 132 connects the lateral end 120 to the superior end, inferior end, anterior side and posterior side. An aperture 134 is provided for the receiver.

The medial and lateral seals 104 and 106, which are frequently formed from a highly porous and highly compliant foam material, suspend and retain the hearing device within the ear canal and also suppress sound transmission and feedback which can occur when there is acoustic leakage between the receiver and microphone. The medial seal 104 includes a shell wall 136 with a base portion 138 and an outwardly bowed portion 140. The base portion 138 includes an opening 142 that is sized and shaped for mounting on the hearing device core 102. The region of the base portion that covers the medial corner 130 is compressed. A cavity (or "air gap") 144 is defined between the exterior surface of the core 102 and the interior surface of the shell wall 136. Similarly, the lateral seal 106 includes a shell wall 146 with a base portion 148, an outwardly bowed portion 150, and an opening 152 that is sized and shaped for mounting on the hearing device core 102. A cavity (or "air gap") 154 is defined between the exterior surface of the core 102 and the interior surface of the shell wall 146. The cavities 144 and 154 allow the bowed portions 140 and 150 to flex inwardly toward the core 102 as necessary.

Although extended wear hearing devices such as that illustrated in FIGS. 2-4 have proven to be an advance in the art, the present inventors have determined that they are susceptible to improvement. For example, there are a variety of important, and sometimes conflicting, functional goals associated with the seals. The seals should properly orient the hearing device, prevent lateral or medial migration and prevent feedback by providing acoustic attenuation, without exerting excessive pressure on the ear canal wall. The seals should also permit venting for pressure equalization and permit water vapor transmission to avoid moisture accumulation. The seals illustrated in FIGS. 2-4 retain their properties and are capable of accomplishing these goals for the entire time that the hearing device is within the ear canal. Other goals have proven to be more problematic. During the insertion process, the hearing device 100 is guided around the curvatures of the ear canal to the intended location adjacent to the tympanic membrane. The base portion 138 of the medial seal 104 protects the patient from discomfort and ear canal trauma that may be caused by contact with core 102. The medial seal base portion 138 may, however, be the source of discomfort in some patients once the hearing device 100 has reached the intended location adjacent to the tympanic membrane due to misalignment caused by the bony region imperfections. Although the bowed portions 140 and 150 of the medial and lateral seals 104 and 106 will align the central and lateral portions of the hearing device 100 with the ear canal, the medial end of the hearing device may be misaligned. As a result, the medial seal base portion 138, which is somewhat incompressible due to the presence of the medial corner 130 of the core 102, presses against the bony region and may cause discomfort for the entire period of extended wear.

SUMMARY

A hearing device in accordance with at least one of the present inventions includes a hearing device core defining an exterior surface with a medial end and a medial corner, at least one seal, defining a seal compliance, carried on the hearing device core, and a medial bumper, defining a medial bumper compliance that is greater than the seal compliance, carried on the hearing device core. There are a variety of advantages associated with such a hearing device. By way of example, but not limitation, the medial bumper will typically not engage the bony region adjacent to the tympanic membrane (even when there is misalignment) and, in those instances where the medial bumper does engage the bony region, the more compliant medial bumper material will readily compress and will not cause discomfort during periods of extended wear.

A method device in accordance with at least one of the present inventions includes the steps of moving a hearing device, including a core with a sound port, at least one seal carried by the core, and a flap that covers the sound port, through the ear canal toward the tympanic membrane, and uncovering the sound port by moving the flap when the hearing device is adjacent to the tympanic membrane. There are a variety of advantages associated with such a method. By way of example, but not limitation, the method prevents cerumen from entering or otherwise obstructing the sound port during the insertion process.

The above described and many other features of the present inventions will become apparent as the inventions become better understood by reference to the following detailed description when considered in conjunction with the accompanying drawings.

BRIEF DESCRIPTION OF THE DRAWINGS

Detailed descriptions of the exemplary embodiments will be made with reference to the accompanying drawings.

FIG. 2 is a perspective view of an extended wear hearing device.

FIG. 3 is an end view of the hearing device illustrated in FIG. 2.

FIG. 4 is a partial section view taken along line 4-4 in FIG. 2.

DETAILED DESCRIPTION OF EXEMPLARY EMBODIMENTS

Figure 1:
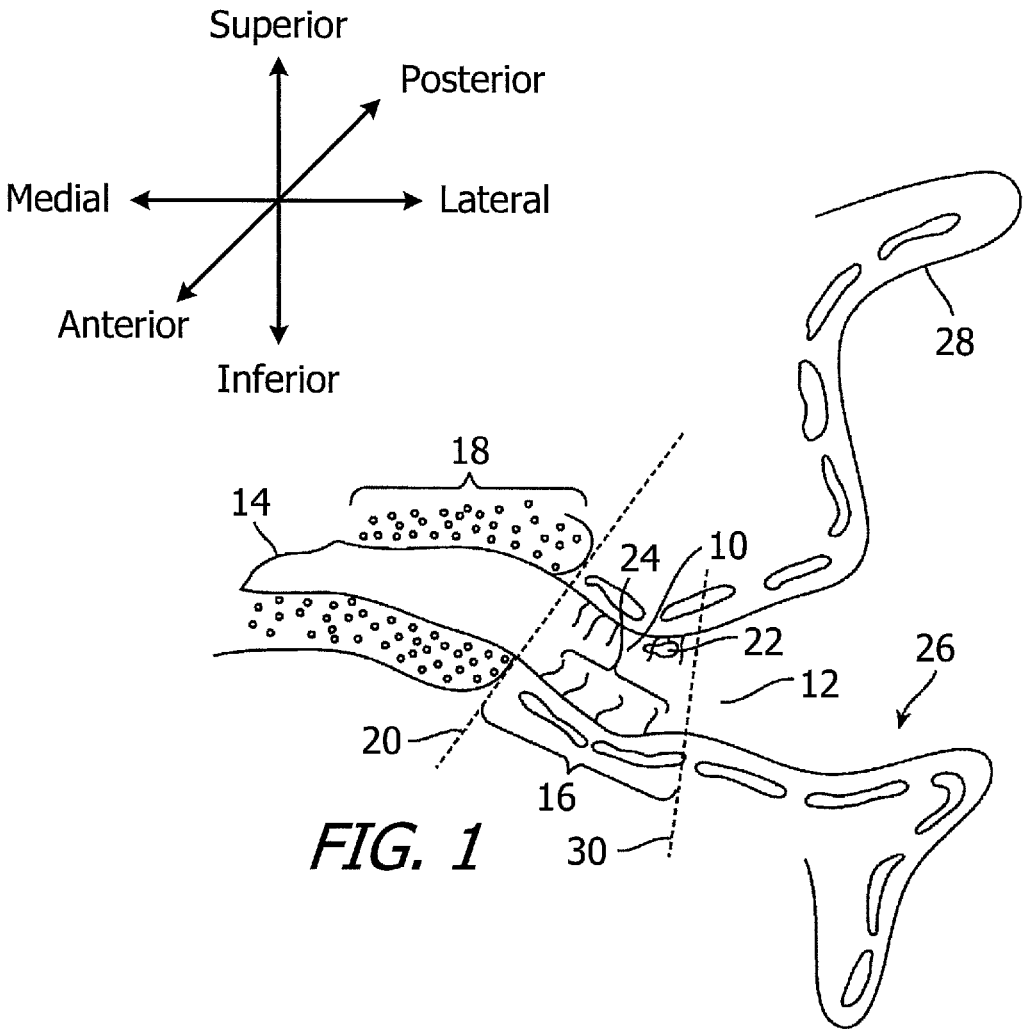
FIG. 1 is a section view showing the anatomical features of the ear and ear canal.

The following is a detailed description of the best presently known modes of carrying out the inventions. This description is not to be taken in a limiting sense, but is made merely for the purpose of illustrating the general principles of the inventions.

The exemplary hearing device 200 illustrated in FIGS. 5-12 includes a core 202, a medial bumper 204, a middle seal 206 and a lateral seal 208. The medial bumper 204 is more compliant than the middle and lateral seals 206 and 208. Put another way, the amount of pressure per unit distance required to move the outer surface of the more compliant medial bumper 204 towards the core 202 is less than the amount of pressure per unit distance required to move the outer surface of the less compliant middle seal 206 (or lateral seal 208) towards the core 202. As discussed in greater detail below with reference to FIGS. 10A-12, the medial bumper 204 protects the ear canal in those instances where the medial end of the hearing device 200 comes into contact with the ear canal during the insertion process. Given that the medial bumper 204 is not used for sound attenuation, which is a function of the middle and lateral seals 206 and 208, the medial bumper will typically not press against the bony region when the hearing device 200 is in its use location adjacent to the tympanic membrane, thereby avoiding the discomfort that may be associated with a conventional extended wear hearing device. In those instances where such contact is unavoidable, e.g., due to the configuration of the ear canal, the relative compliance of medial bumper 204 (as compared to the seals 206 and 208) causes the medial bumper to readily compress, which prevents discomfort during periods of extended wear. In some exemplary implementations, the medial bumper 204 may be formed from a more compliant material than the middle and lateral seals 206 and 208. Alternatively, or in addition, the configuration of the medial bumper in some exemplary implementations produces the additional compliance. For example, the medial bumper 204 may be configured so as to allow the hearing device to avoid direct compression of the medial bumper between the inner surface of the ear canal and the outer surface of the core. The medial bumper 204 may also be configured in such a manner that it traps liquid cerumen that may migrate medially along the sound attenuating middle and lateral seals 206 and 208 and could otherwise block the receiver port.

Figure 5:
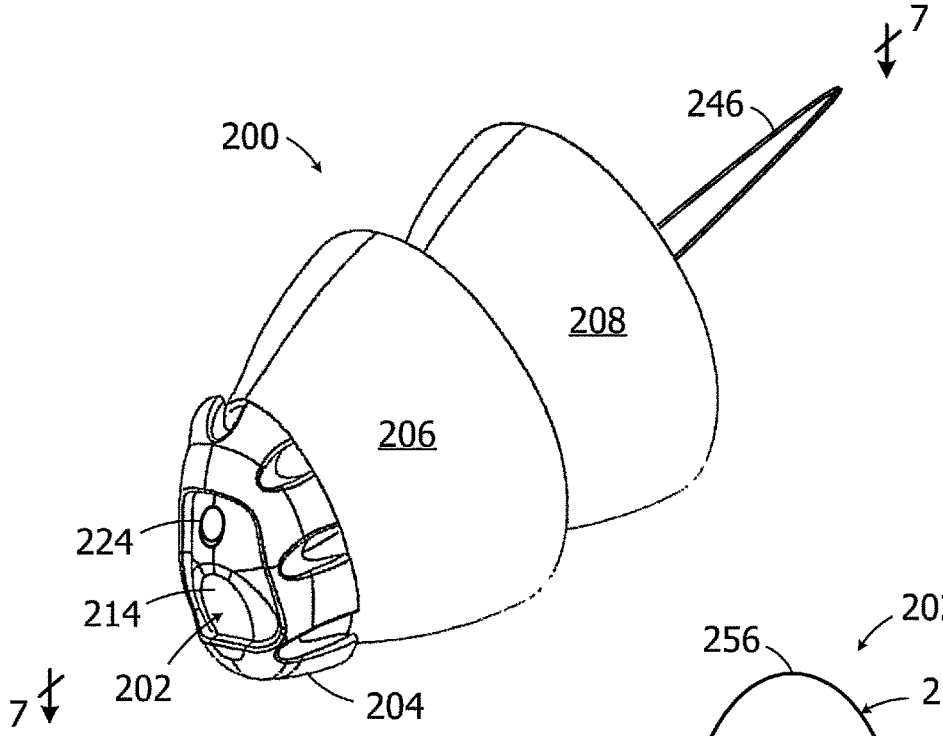
FIG. 5 is a perspective view of an extended wear hearing device in accordance with one embodiment of a present invention.
Figure 6:
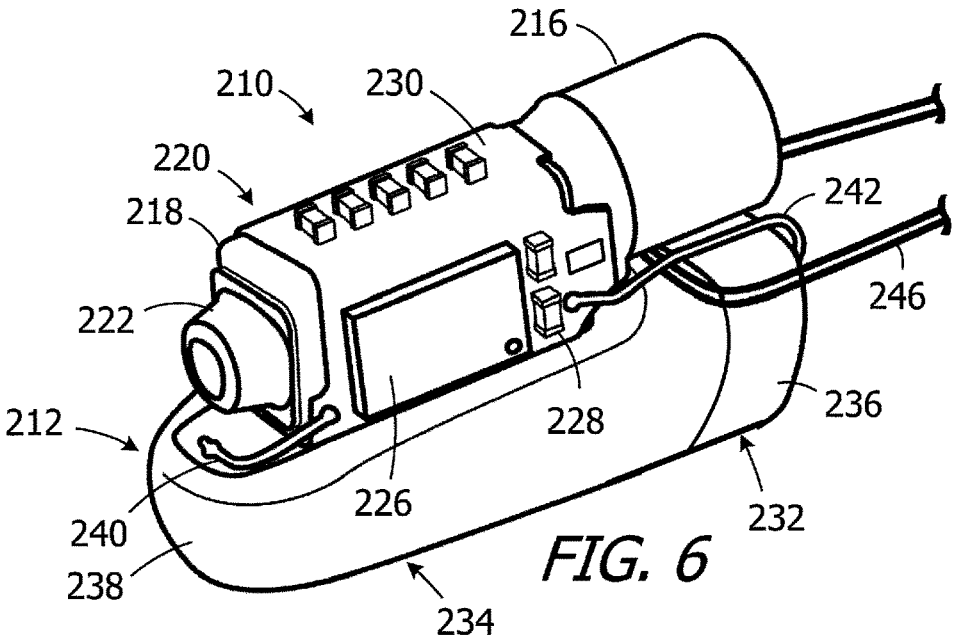
FIG. 6 is a perspective view of a portion of the hearing device illustrated in FIG. 5.
Figure 7:
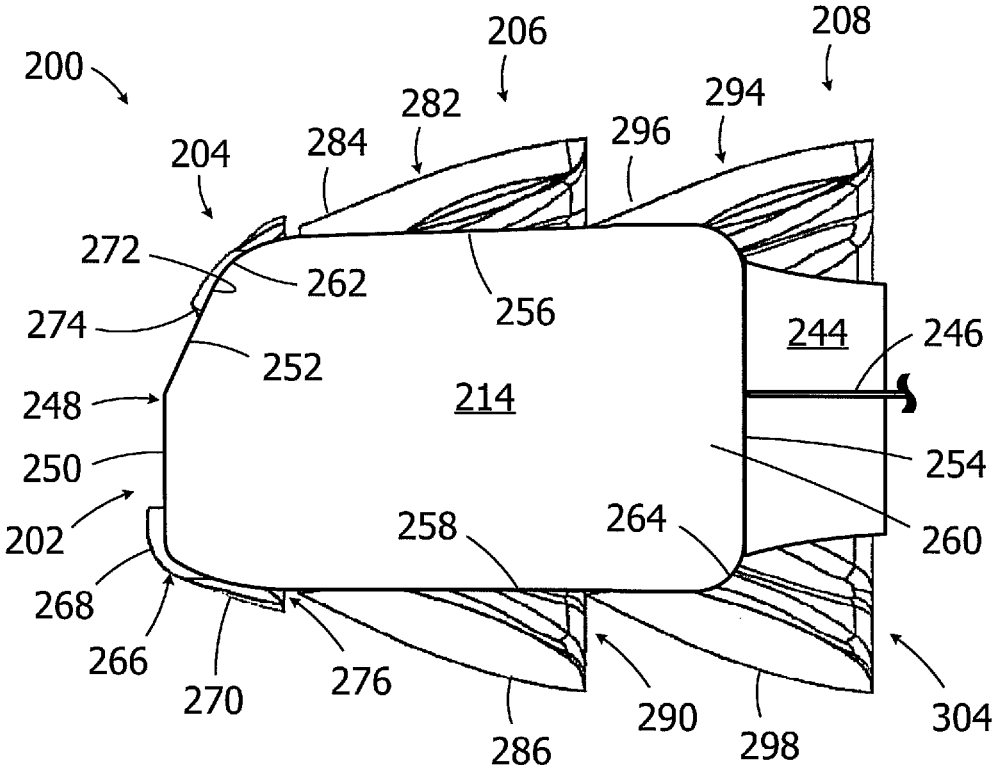
FIG. 7 is a partial section view taken along line 7-7 in FIG. 5.

Referring first to FIGS. 5-7, and although the present inventions are not limited to any particular cores, the exemplary core 202 includes an acoustic assembly 210 and a battery 212 (e.g., metal-air battery) located within a housing 214. The acoustic assembly 210 has a microphone 216, a receiver 218 and a flexible circuit 220. The receiver 218 has a sound port 222 that is associated with an aperture 224 on the housing 214. The exemplary flexible circuit 220 includes an integrated circuit or amplifier 226 and other discreet components 228 on a flexible printed circuit board ("PCB") 230. The exemplary battery 212 has a cathode assembly 232 and an anode assembly 234. The exemplary cathode assembly 232 includes a battery can cathode portion 236 and an air cathode (not shown), and the exemplary anode assembly 234 includes a battery can anode portion 238 and anode material (not shown). The cathode assembly 232 and anode assembly 234 may initially be separate, individually formed structural elements that are joined to one another during the manufacturing process. The exemplary battery 212 is electrically connected to the PCB 230 by way of anode and cathode wires 240 and 242. The battery 212 may, in other implementations, be connected to a similar PCB via tabs of the PCB that attach to the battery, and in still other implementations the anode and cathode wires may be omitted and replaced by anode and cathode contacts on the cathode assembly. A contamination guard 244 (FIG. 7) with a screen (not shown) abuts the microphone 216. A handle 246 may also be provided.

Figure 5A:
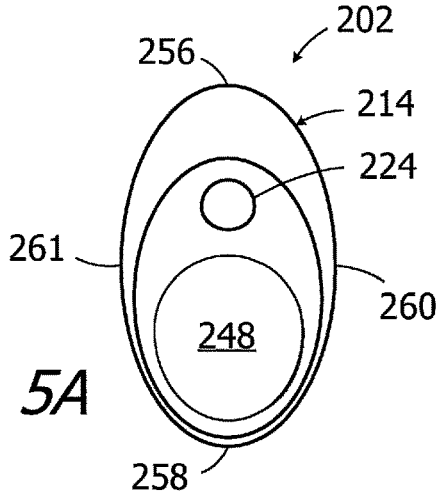
FIG. 5A is a perspective view of a portion of the hearing device illustrated in FIG. 5.

Referring more specifically to FIGS. 5A and 7, the exemplary core 202 has a medial end 248 with surfaces 250 and 252, a lateral end 254, a superior end 256, an inferior end 258, an anterior side 260, and a posterior side 261. A curved medial corner 262 connects the medial end 248 to the superior end 256, inferior end 258, anterior side 260 and posterior side, while a curved lateral corner 264 connects the lateral end 254 to the superior end, inferior end, anterior side and posterior side. In the illustrated implementation, these points of reference on the core 202 are defined by the housing 214. In other implementations, the housing 214 may be omitted and the acoustic assembly 210, or the acoustic assembly and the battery 212, or the acoustic assembly alone, may be encased by an encapsulant. Additional details concerning the present hearing assistance device cores may be found in U.S. Pat. No. 8,761,423, which is incorporated herein by reference.

As noted above, the compliance of the medial bumper 204, i.e., the distance that the outer edge of the bumper will deflect in response to the application of a predetermined pressure, is greater than the compliance of the middle and lateral seals 206 and 208, i.e., the distance that the outer edge of the seals will deflect in response to the application of the same predetermined pressure. In some implementations, the compliance of the medial bumper 204 will be two or more times greater than the compliance of the seals 206 and 208. Put another way, and given that compliance is inversely related to the amount of pressure exerted onto the ear canal by the bumper and seals, the maximum pressure exerted on the ear canal by the more compliant medial bumper 204 may be between about 0 mmHg (no contact) and about 2 mmHg, while the maximum pressure exerted on the ear canal by the less compliant seals 206 and 206 may be between about 4 mmHg and about 12 mmHg. In some implementations, the medial bumper 204 may have a mass that is about 25% or less of the mass of either one of the seals 206 and 208. In some implementations, the attenuation provided by the medial bumper 204 will be between about 0 dB and about 6 dB, while the attenuation provided by the seals 206 and 208 acting together will be between about 20 dB and about 60 dB measured at 4 kHz in a typical ear canal.

The relatively high compliance of the medial bumper 204 may in some instances be a result of the configuration of the bumper. In particular, there may be an air gap between the exterior surface of the medial bumper 204, i.e., the surface of the medial bumper that faces and in some instances may contact the ear canal, and the exterior surface of the core 202.

Figure 8:
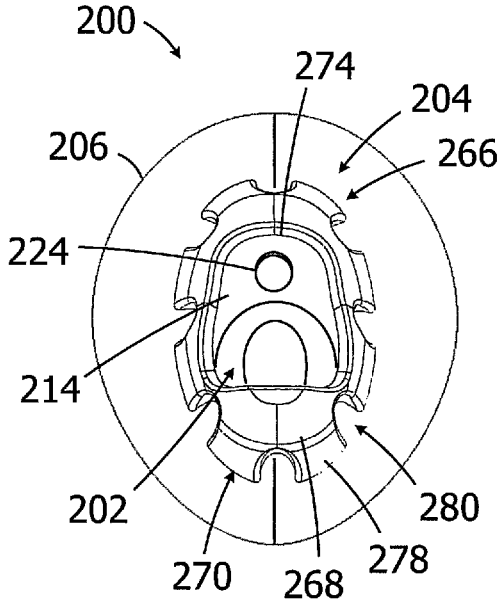
FIG. 8 is an end view of the hearing device illustrated in FIG. 5.
Figure 9:
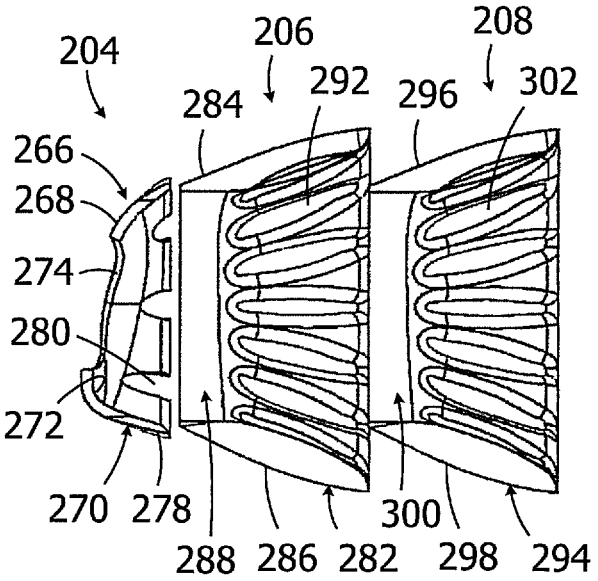
FIG. 9 is a section view of a portion of the hearing device illustrated in FIG. 5.

As illustrated for example in FIGS. 7-9, the exemplary medial bumper 204 includes a bumper wall 266 with a base portion 268 and an outwardly bowed portion 270. The base portion 268 includes an inner surface 272, which is adhered (e.g., with adhesive) to the core medial end 248 and a portion of the medial corner 262, and an opening 274 that exposes a portion of the medial end 248 as well as the sound port aperture 224. A cavity (or "air gap") 276 is defined between the exterior surface of the core 102 and the interior surface of the bowed portion 270. As discussed in greater detail below with reference to FIGS. 10A-12, the bowed portion 270 will bend into the air gap 276 should it come into contact with the ear canal during the insertion process. The outwardly bowed portion 270 traps liquid cerumen (in the air 276) that may migrate medially along the middle and lateral seals 206 and 208 towards the receiver sound port 222 and housing aperture 224. In some instances, steps may be taken to increase the flexibility of an outwardly bowed portion. In the exemplary medial bumper 204, the outwardly bowed portion 270 consists of a plurality of individual projections 278 separated by gaps 280 that extend completely through the outwardly bowed portion. So configured, the outer perimeter of the lateral end of the medial bumper includes a plurality of discontinuities.

The middle and lateral seals 206 and 208, which may also be attached to the core 202 with adhesive, support the core within the ear canal bony portion and are configured to substantially conform to the shape of walls of the ear canal, maintain an acoustical seal between a seal surface and the ear canal, and retain the hearing device 200 securely within the ear canal. The middle and lateral seals 206 and 208 may be identical or essentially identical, but for minor variations in shape. The middle seal 206 includes a shell wall 282 with a base portion 284 and an outwardly bowed portion 286. The base portion 284 includes an opening 288 that is sized and shaped for mounting on the hearing device core 202. The opening 288 may be centrally placed or offset with respect to the shell wall 282, and may be oval, substantially circular or square. The outwardly bowed portion 286 is sized and shaped such that it will be spaced apart from the outer surface of the hearing device core 202. A cavity 290 is defined between the exterior surface of the hearing device core 202 and the interior surface of the outwardly bowed portion 286. A plurality of scallops 292 may be used to impart the desired level of stiffness and conformability to the shell wall 282. Similarly, the lateral seal 208 includes a shell wall 294 with a base portion 296 and an outwardly bowed portion 298, an opening 300, and scallops 302. A cavity 304 is defined between the exterior surface of the contamination guard 244 and the interior surface of the outwardly bowed portion 298.

Additionally, although the middle and lateral seals 206 and 208 are identical, or essentially identical, in the illustrated implementation, they may be different in other implementations. By way of example, but not limitation, the lateral seal 208 may be larger or smaller than the middle seal. In other implementations, the middle and lateral seals 206 and 208 may be combined into a single seal that, for example, extends in the medial-lateral direction over the same portion of the core 202 as the middle and lateral seals. In other implementations, there may be three or more seals in place of the middle and lateral seals 206 and 208.

Figure 10A:
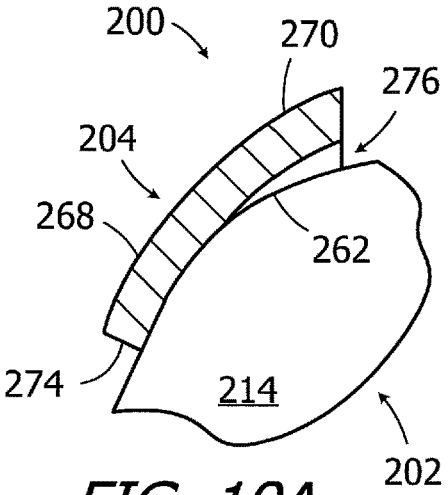
FIG. 10A is a partial section view of a portion of the hearing device illustrated in FIG. 5.
Figure 11A:
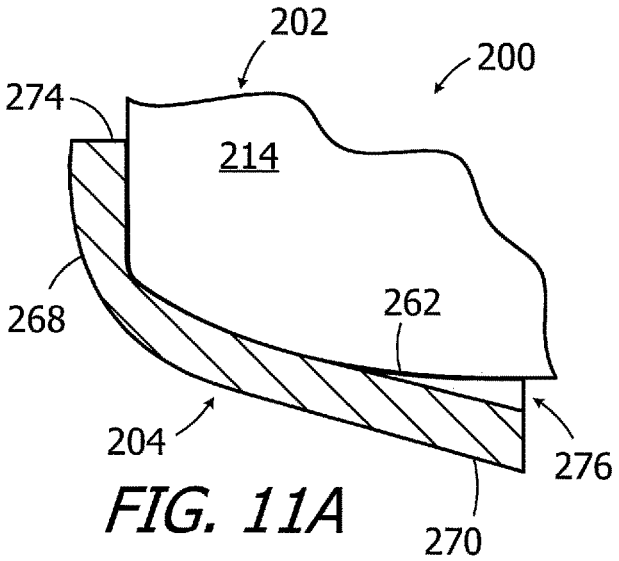
FIG. 11A is a partial section view of a portion of the hearing device illustrated in FIG. 5.
Figure 10B:
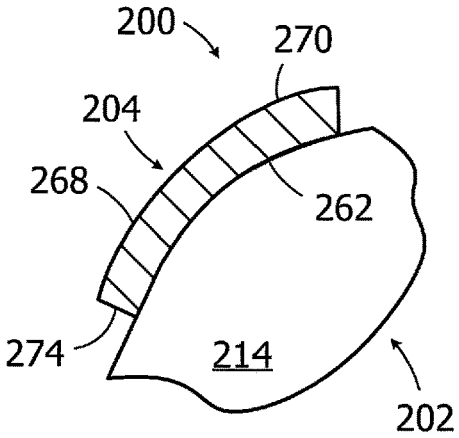
FIG. 10B is a partial section view of a portion of the hearing device illustrated in FIG. 5 with a portion of the medial bumper in a compressed state.
Figure 11B:
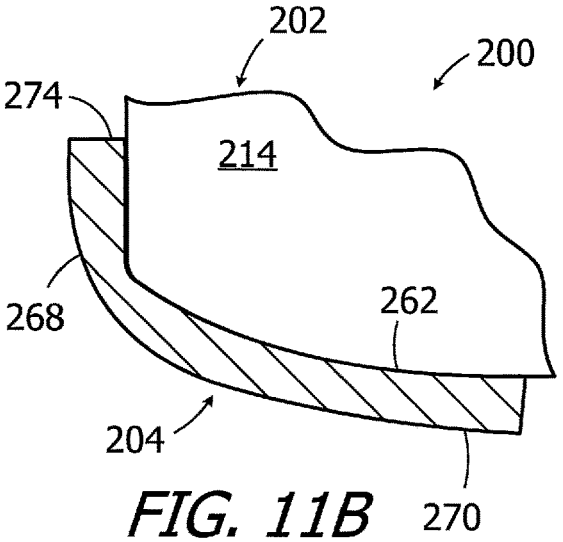
FIG. 11B is a partial section view of a portion of the hearing device illustrated in FIG. 5 with a portion of the medial bumper in a compressed state.

FIGS. 10A and 11A show the medial bumper 204 in its relaxed, unstressed state. Here, the air gap 276 between the exterior surface of the core 202 and the interior surface of the bowed portion 270 is coextensive with a portion of the curved medial corner 262, and extends completely around the core. In other words, there is an air gap between the medial corner 262 of the core 202 and the medial bumper 204 that extends over the superior, inferior, anterior and posterior portions of the medial corner. The medial bumper 204 protects the patient from ear canal trauma and discomfort that may be caused by contact with medial end 248 and medial corner 262 of the core 102 during insertion. The air gap 276 permits movement of the bowed portion 270 of the medial bumper 204, as can be seen in FIGS. 10B and 11B, in those instances where the medial bumper comes into contact with the ear canal during the insertion process to further increase comfort.

Figure 12:
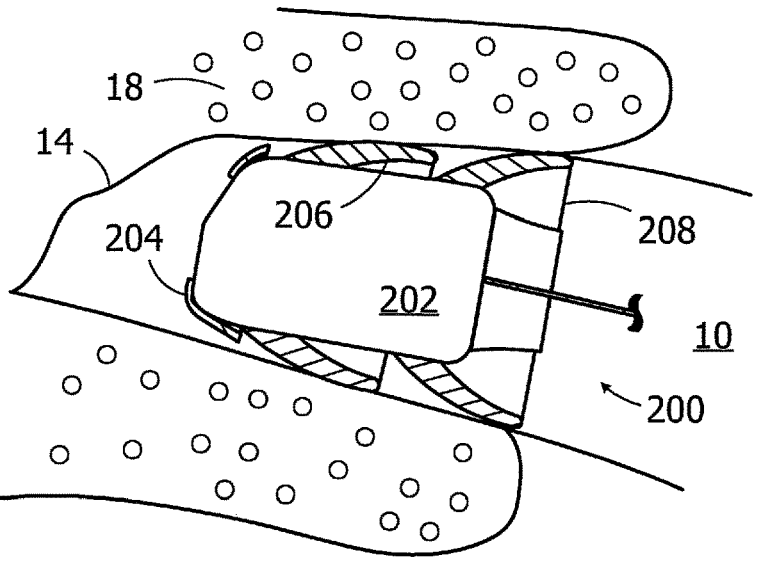
FIG. 12 is a partial section view showing the hearing device illustrated in FIG. 5 within the ear canal.

Turning to FIG. 12, and although the medial bumper may come into contact with the ear canal during the insertion process, the size and shape of the medial bumper 204 is such that the medial bumper will not come into contact with (i.e., will be spaced apart from) the inner surface bony region 18 when the hearing device 200 is in its use location adjacent to the tympanic membrane 14. As such, the medial bumper 204 will not press against the bony region 18 and cause discomfort. The maximum dimension of the exemplary medial bumper 204 superior-inferior direction (which occurs at the lateral end of the bumper) may be 7.5 mm or less, while the maximum dimension of the exemplary medial bumper 204 anterior-posterior direction (which also occurs at the lateral end of the bumper) may be 4.5 mm or less. In those instances where such contact is unavoidable, e.g., due to the configuration of the ear canal, the presence of the air gap 276 will allow the medial bumper 204 to avoid direct compression between the inner surface of the ear canal and the outer surface of the core 202. The bowed portion 270 will also, as noted above, trap liquid cerumen (in the air 276) that may migrate medially along the middle and lateral seals 206 and 208 towards the receiver sound port 222 and housing aperture 224.

With respect to materials, the middle and lateral seals 206 and 208 may be formed from compliant material configured to conform to the shape of the ear canal and provide necessary sound attenuation. Suitable materials include elastomeric foams having compliance properties (and dimensions) configured to conform to the shape of the intended portion of the ear canal (e.g., the bony portion) and exert a spring force on the ear canal so as to hold the hearing assistance device 200 in place in the ear canal. Exemplary foams, both open cell and closed cell, include but are not limited to foams formed from polyurethanes, silicones, polyethylenes, fluoropolymers and copolymers thereof. Hydrophilic polyurethane foam is one specific example. In at least some embodiments, all or a portion of the seals can comprise a hydrophobic material including a hydrophobic layer or coating that is also permeable to water vapor transmission. Examples of such materials include, but are not limited to, silicones and fluoropolymers such as expanded polytetrafluoroethylene (PTFE).

The medial bumper 204, on the other hand, is not intended to make contact with the ear canal except during insertion of the device and, as a result, the bumper material need not to be optimized for sound attenuation and/or vapor transport. As such, the medial bumper 204 may be formed from a material that is different than that which is used to form the middle and lateral seals 206 and 208 in at least one aspect (e.g., chemical composition or porosity). Suitable materials for the medial bumper 204 (and other medial bumpers described below) include, but are not limited to, the low durometer silicone rubber, silicone gels and hydrogels. The medial bumper 204 may also be formed from materials described above with respect to the middle and lateral seals 206 and 208. Additional information concerning seals and seal materials may be found in U.S. Pat. No. 7,580,537, which is incorporated herein by reference.

Figure 13:
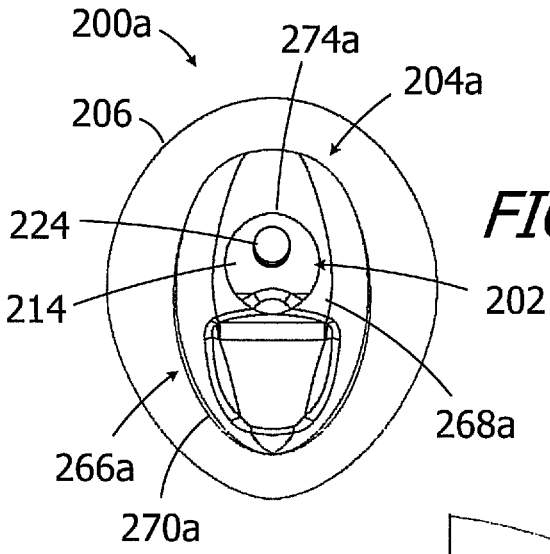
FIG. 13 is an end view of a hearing device in accordance with one embodiment of a present invention.
Figure 14:
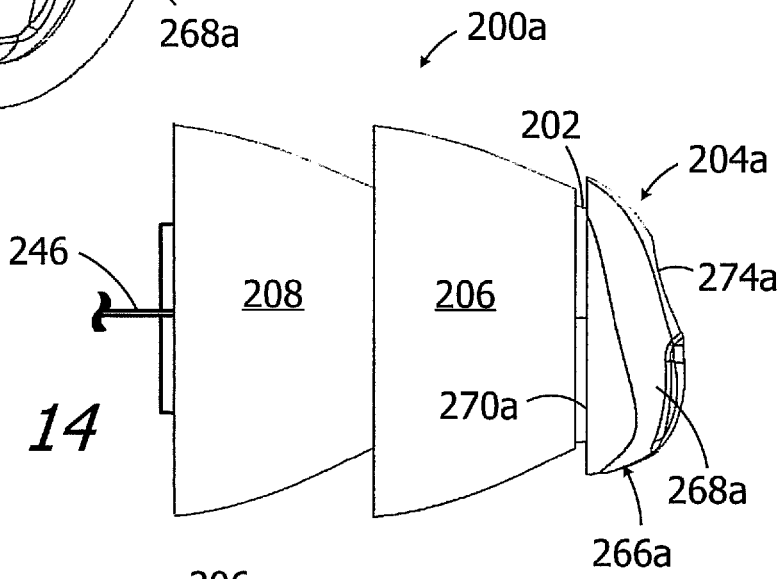
FIG. 14 is a side view of the hearing device illustrated in FIG. 13.
Figure 15:
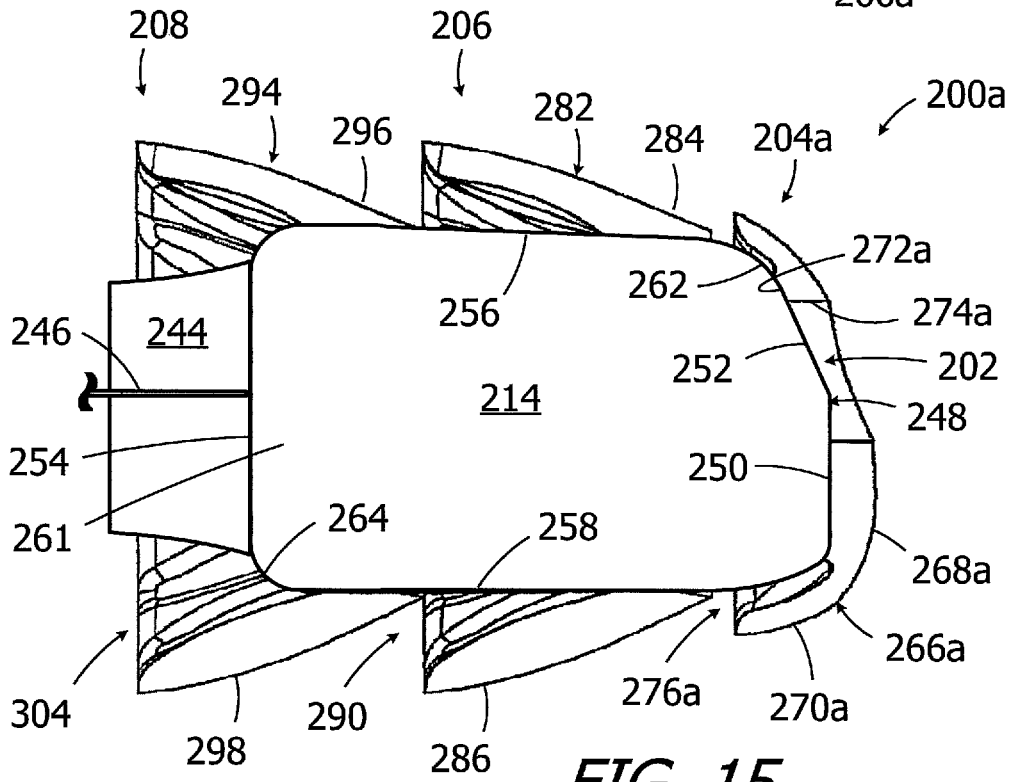
FIG. 15 is a partial section view of the hearing device illustrated in FIG. 13.

Another exemplary hearing device is generally represented by reference numeral 200*a* in FIGS. 13-15. The exemplary hearing device 200*a* is substantially similar to hearing device 200 and similar elements are represented by similar reference numerals. For example, the hearing device 200*a* includes the above-described core 202, middle seal 206 and lateral seal 208. Here, however, a slightly larger and thicker medial bumper 204*a* is provided. To that end, the maximum dimension of the exemplary medial bumper 204*a* superior-inferior direction (which occurs at the lateral end of the bumper) may be 8.0 mm or less, while the maximum dimension of the exemplary medial bumper 204*a* anterior-posterior direction (which also occurs at the lateral end of the bumper) may be 5.0 mm or less.

The medial bumper 204*a* includes a bumper wall 266*a* with a base portion 268*a* and an outwardly bowed portion 270*a*. The base portion 268*a* includes an inner surface 272*a*, which is adhered (e.g., with adhesive) to the core medial end 248, and an opening 274*a* that exposes the portion of the medial end 248 that includes the sound port aperture 224. An air gap 276*a* is defined between the exterior surface of the core 102 and the interior surface of the bumper bowed portion 270*a*. The outwardly bowed portion 270*a* also traps liquid cerumen (in the air 276*a*) that may migrate medially along the middle and lateral seals 206 and 208 towards the receiver sound port 222 and housing aperture 224.

Figure 16:
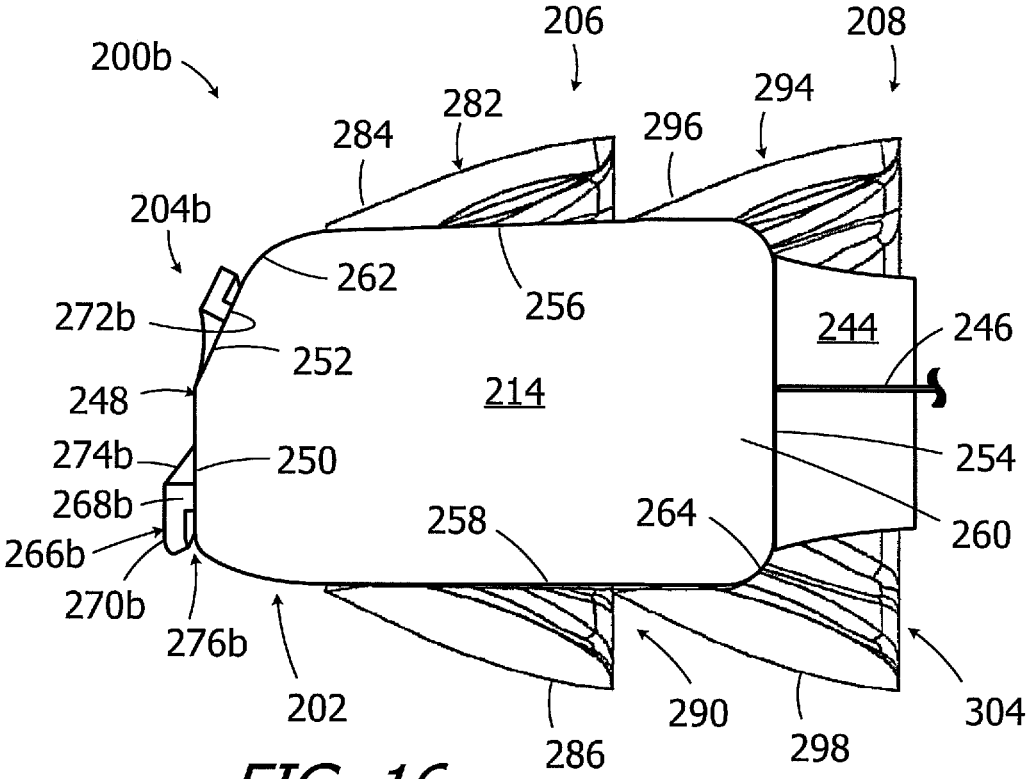
FIG. 16 is a partial section view of a hearing device in accordance with one embodiment of a present invention.
Figure 17:
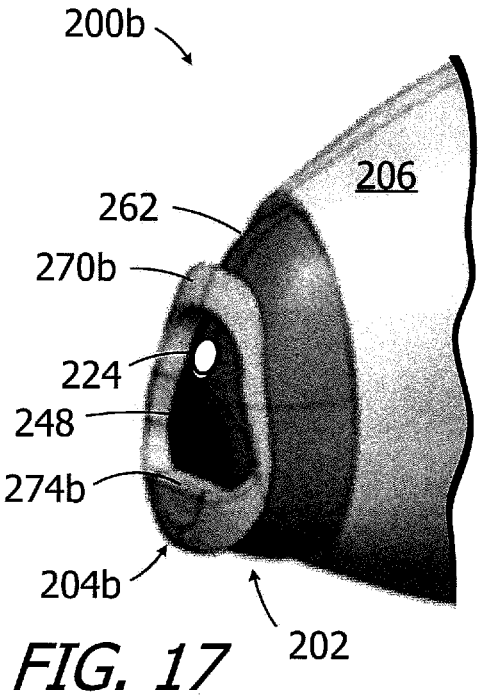
FIG. 17 is a perspective view of a portion of the hearing device illustrated in FIG. 16.

Still another exemplary hearing device is generally represented by reference numeral 200*b* in FIGS. 16-17. The exemplary hearing device 200*b* is substantially similar to hearing device 200 and similar elements are represented by similar reference numerals. For example, the hearing device 200*b* includes the above-described core 202, middle seal 206 and lateral seal 208. Here, however, the medial bumper 204*b* is somewhat smaller than the bumper 204 and does not cover the medial corner 262 of the core 102. The maximum dimension of the exemplary medial bumper 204*b* superior-inferior direction (which occurs at the lateral end of the bumper) may be 5.0 mm or less, while the maximum dimension of the exemplary medial bumper 204 anterior-posterior direction (which also occurs at the lateral end of the bumper) may be 2.5 mm or less.

The medial bumper 204*b* includes a bumper wall 266*a* with a base portion 268*a* and an outwardly bowed portion 270*b*. The base portion 268*a* includes an inner surface 272*b*, which is adhered (e.g., with adhesive) to the core medial end 248, and an opening 274*b* that exposes the portion of the medial end 248 that includes the sound port aperture 224. An air gap 276*b* is defined between the exterior surface of the core 202 (at the medial end 248) and the interior surface of the bumper outwardly bowed portion 270*b*. The outwardly bowed portion 270*b* also traps liquid cerumen (in the air 276*b*) that may migrate medially along the middle and lateral seals 206 and 208 towards the receiver sound port 222 and housing aperture 224.

Figure 17A:
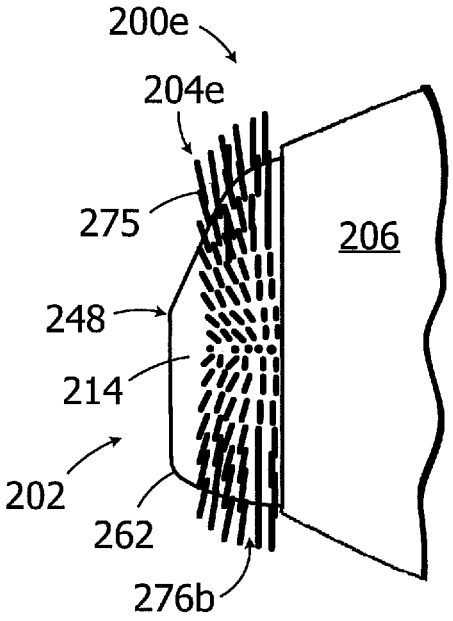
FIG. 17A is a side view of a portion hearing device in accordance with one embodiment of a present invention.

Various other structural configurations may be used create air gaps. To that end, and referring to FIG. 17A, the exemplary hearing device 200*e* is substantially similar to hearing device 200 and similar elements are represented by similar reference numerals. For example, the hearing device 200*e* includes the above-described core 202, the middle seal 206 and a lateral seal (not shown). Here, however, the medial bumper 204*e* is formed from a plurality of soft, spaced projections 275. The spaced projections 275 are attached at one end to the exterior of the core housing 214, and extend outwardly away from the core 202 to a free end. In other implementations, the projections 275 may be attached to a thin base that is attached to the core housing 214. The space located between the free ends of the projections 275 and core 202, which is also between the projections themselves, defines an air gap 276*e*. Suitable projections including filaments formed from soft materials such as silicone. The projections 275 may be straight (as shown), curved, or otherwise non-linear. Alternatively, or in addition, the projections 275 may be isolated from one another when in a relaxed state (as shown) or may be loosely entangled with on other.

The medial bumper 204*e* protects the patient from ear canal trauma and discomfort that may be caused by contact with medial end 248 and medial corner 262 of the core 102 during insertion. The air gap 276*e* permits movement of some or all of the projections of the medial bumper 204*e* in those instances where the medial bumper comes into contact with the ear canal during the insertion process.

Figure 18:
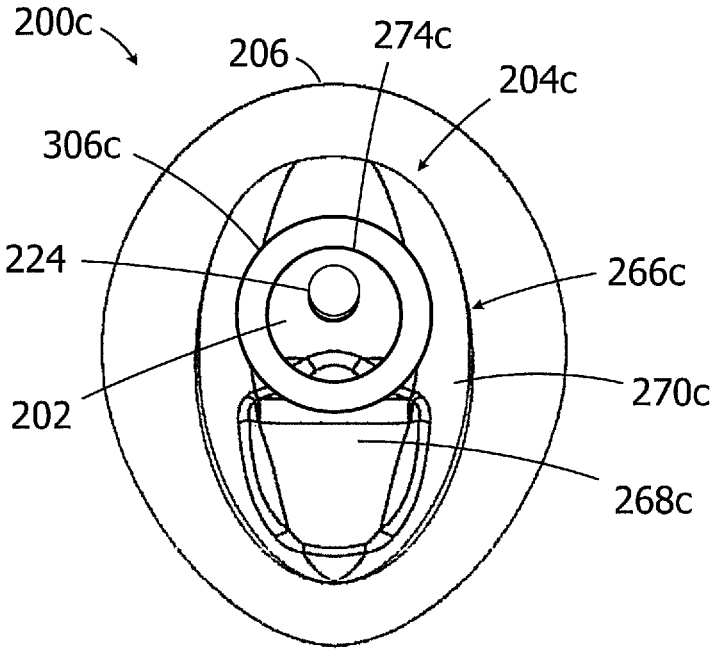
FIG. 18 is an end view of a hearing device in accordance with one embodiment of a present invention.
Figure 19:
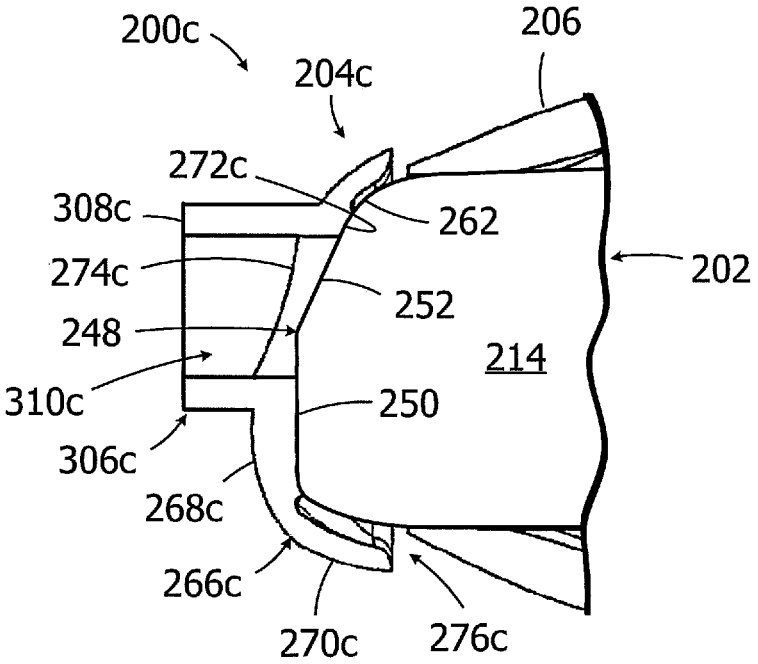
FIG. 19 is a partial section view of a portion of the hearing device illustrated in FIG. 18.

Additional structures may also be provided to reduce the likelihood that cerumen will enter the housing sound aperture 224. To that end, and referring to FIGS. 18 and 19, the exemplary hearing device 200*c* is substantially similar to hearing device 200*a* and similar elements are represented by similar reference numerals. For example, the hearing device 200*b* includes the core 202, middle seal 206 and lateral seal 208 (not shown). The medial bumper 204*c* includes a bumper wall 266*c* with a base portion 268*c* and an outwardly bowed portion 270*c*. The base portion 268*c* includes an inner surface 272*c*, which is adhered (e.g., with adhesive) to the core medial end 248, and an opening 274*c* that exposes the portion of the medial end 248 that includes the sound port aperture 224. An air gap 276*c* is defined between the exterior surface of the core 102 and the interior surface of the bumper bowed portion 270*a*. The outwardly bowed portion 270*c* also traps liquid cerumen (in the air 276*c*) that may migrate medially along the middle and lateral seals 206 and 208 towards the receiver sound port 222 and housing aperture 224. Here, however, the medial bumper 204*c* also includes a cerumen guard 306*c*. In the illustrated implementation, cerumen guard 306*c* consists of a tubular member 308*c* that extends medially from the base portion 268*c* and that has a lumen 310*c* which is aligned with the opening 274*c*.

Figure 20:
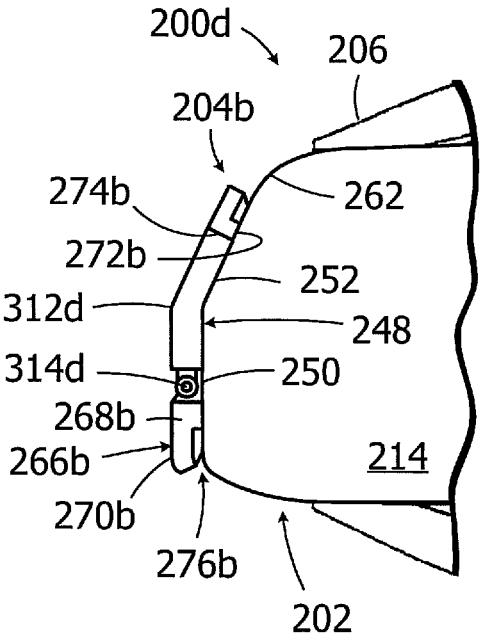
FIG. 20 is a partial section view of a portion of a hearing device in accordance with one embodiment of a present invention.
Figure 21:
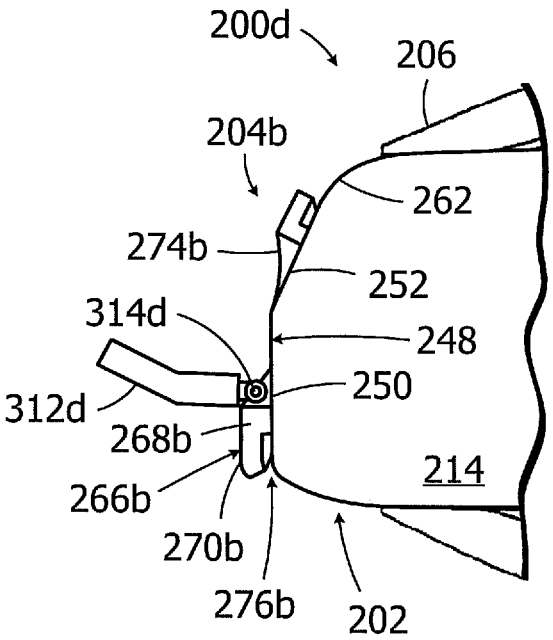
FIG. 21 is a partial section view of a portion of the hearing device illustrated in FIG. 20.

Hearing devices in accordance with the present inventions may also be configured to cover the receiver sound port 222 and housing aperture 224 during the insertion process, and to thereafter uncover the sound port and aperture, in order to prevent cerumen from entering the aperture and sound port during the insertion process. By way of example, but not limitation, the exemplary hearing device 200*d* illustrated in FIGS. 20 and 21 is substantially similar to hearing device 200*b* and similar elements are represented by similar reference numerals. Here, however, a movable flap 312*d* is positioned within the opening 274*b* of the medial bumper 204*b*. The flap 312*d*, which is movable between the closed position illustrated in FIG. 20 and the open position illustrated in FIG. 21, may be configured such that it fills the entire opening 274*b* (as shown) or less than the entire opening 274*b* so long as the receiver sound port 222 and housing aperture 224 are covered during the insertion process. In the illustrated implementation, the flap 312*d* is supported on a hinge 314*d*. The flap 312*d* may, in some instances, be biased to the open position. One or more of the medial bumper 204*b*, the flap 312*d* and the hinge 314*d* may be configured in such a manner that the flap will move from the closed position to the open position in response to prolonged exposure to the elevated humidity and/or elevated temperature within the ear canal, as compared to ambient humidity and temperature outside the ear canal (i.e., exposure for a time period that is at least sufficient for the hearing device to be moved through to the ear canal to a location adjacent to the tympanic membrane). Alternatively, or in addition, the core 202 may include structures that are configured to push the flap 312*d* from the closed position to the open position.

Figure 22:
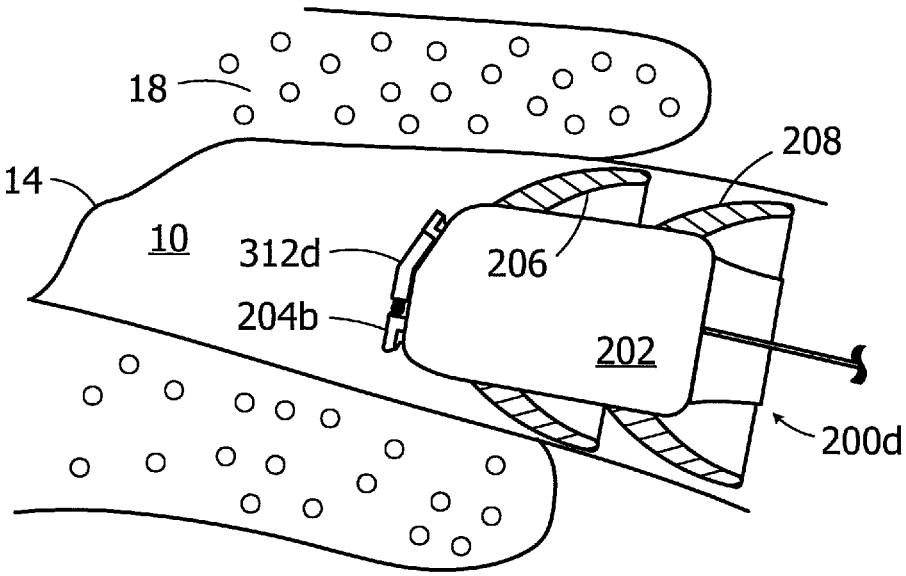
FIG. 22 is a partial section view showing the hearing device illustrated in FIG. 20 in the ear canal with the flap in the closed position.
Figure 23:
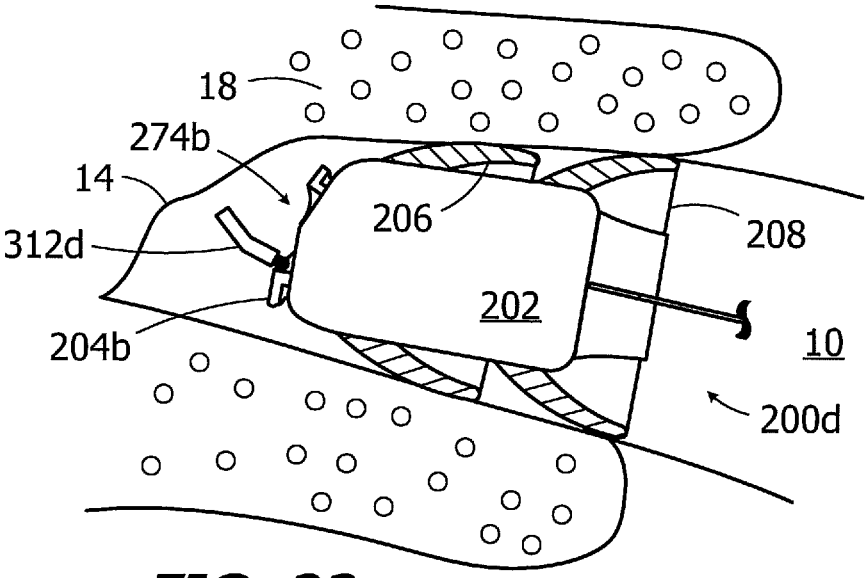
FIG. 23 is a partial section view showing the hearing device illustrated in FIG. 20 in the ear canal with the flap in the open position.

As alluded to above, referring to FIG. 22, the hearing device 200*d* may be inserted into the ear canal 10 and advanced in the medial direction with the flap 312*d* in the closed position. The flap 312*d* may be opened when the hearing device reaches intended location adjacent to the tympanic membrane 14, or reaches a location that is slightly lateral of the tympanic membrane. Opening of the flap 312*d* may be automatic (i.e., may occur without user actuation) or may be user actuated.

Although the inventions disclosed herein have been described in terms of the preferred embodiments above, numerous modifications and/or additions to the above-described preferred embodiments would be readily apparent to one skilled in the art. By way of example, but not limitation, the inventions include any combination of the elements from the various species and embodiments disclosed in the specification that are not already described. It is intended that the scope of the present inventions extend to all such modifications and/or additions and that the scope of the present inventions is limited solely by the claims set forth below.

We claim:

1. A hearing device, comprising:

a hearing device core defining an exterior surface with a medial end and a medial corner, and including a battery, a microphone and a receiver;

at least one seal, defining a seal compliance, carried on the hearing device core; and a medial bumper, defining an exterior surface and a medial bumper compliance that is greater than the seal compliance, carried on the hearing device core, and including a base portion secured to the hearing device core and an outwardly bowed portion extending from the base portion and positioned in spaced relation to the hearing device core such that there is an air gap between the outwardly bowed portion and the exterior surface of one or both of the medial end of the core and the medial corner of the core.

2. The hearing device of claim 1, wherein the medial corner comprises a curved medial corner.

3. The hearing device of claim 1, wherein the hearing device core defines a superior end, an inferior end, an anterior side, and a posterior side; and the medial corner connects the medial end to the superior end, the inferior end, the anterior side and the posterior side.

4. The hearing device of claim 1, wherein the at least one seal includes a shell wall defining a first end secured to the hearing device core and a second end located in spaced relation to the hearing device core.

5. The hearing device of claim 1, wherein the at least one seal comprises a middle seal located lateral of the medial corner of the core and a lateral seal located lateral of the middle seal.

6. The hearing device of claim 1, wherein the hearing device core includes a sound port aperture; and the medial bumper includes an opening that exposes the sound port aperture.

7. The hearing device of claim 6, wherein the medial bumper includes a cerumen guard that extends medially from the base portion and around the opening.

8. The hearing device of claim 6, further comprising:

a flap that is associated with the opening and that is movable between a first position where the flap covers the sound port aperture and a second position where the flap does not cover the sound port aperture.

9. The hearing device of claim 1, wherein the outwardly bowed portion includes a plurality of individual projections that are separated by gaps.

10. The hearing device of claim 1, wherein the medial bumper defines a size and a shape whereby the medial bumper will be spaced apart from the inner surface of the ear canal bony region when the hearing device is adjacent to the tympanic membrane.

11. The hearing device of claim 10, wherein at least a portion of the medial corner of the hearing device core is not in contact with any portion of the at least one seal or the medial bumper.

12. The hearing device of claim 10, wherein no portion of the medial corner of the hearing device core is in contact with any portion of the at least one seal or the medial bumper.

13. The hearing device of claim 1, wherein the medial bumper and the at least one seal are separate structural elements that are not connected to one another.

14. The hearing device of claim 1, wherein the medial bumper is formed from elastomeric foam.

15. The hearing device of claim 1, wherein the medial bumper is formed from a different material than the at least one seal.

16. The hearing device of claim 1, wherein the seal compliance is between about 4 mmHg and about 12 mmHg; and the medial bumper compliance is between about 0 mmHg and about 2 mmHg.

17. The hearing device of claim 1, wherein the at least one seal and the medial bumper define respective masses, and the mass of the medial bumper is 25% or less of the mass of the at least one seal.

* * * * *